US006731249B1

(12) United States Patent
Gau et al.

(10) Patent No.: US 6,731,249 B1
(45) Date of Patent: May 4, 2004

(54) MULTI-BEAM-REFLECTOR DISH ANTENNA AND METHOD FOR PRODUCTION THEREOF

(75) Inventors: Jiahn-Rong Gau, Hsinchu (TW); Cheng-Geng Jan, Hsinchu (TW); Chung-Min Lai, Hsinchu (TW)

(73) Assignee: Wistron Neweb Corporation, Taipei Hsien (TW)

( * ) Notice: Subject to any disclaimer, the term of this patent is extended or adjusted under 35 U.S.C. 154(b) by 0 days.

(21) Appl. No.: 10/405,769

(22) Filed: Apr. 1, 2003

(51) Int. Cl.[7] ..... H01Q 19/12; H01Q 13/00

(52) U.S. Cl. ..... 343/840; 343/779; 343/912; 343/914

(58) Field of Search ..... 343/840, 779, 343/912, 914, 781 R, 781 P, 782; H01Q 19/12, 13/00

(56) References Cited

U.S. PATENT DOCUMENTS 3,680,143 A 7/1972 Ajioka et al. ..... 343/778
4,145,695 A * 3/1979 Gans ..... 343/779
4,355,314 A * 10/1982 Ohm ..... 343/779
4,491,848 A * 1/1985 Dragone ..... 343/781 P
4,757,323 A 7/1988 Duret et al. ..... 343/756
6,219,003 B1 4/2001 Chandler ..... 343/779
6,243,048 B1 6/2001 Luh ..... 343/781 P
6,456,254 B1 * 9/2002 Reineix et al. ..... 343/840
6,492,954 B2 12/2002 Gau et al. ..... 343/776

* cited by examiner

*Primary Examiner*—Hoanganh Le
(74) *Attorney, Agent, or Firm*—Ladas & Parry

(57) ABSTRACT

A multi-beam-reflector dish antenna system. Signals from different satellites are simultaneously received using a single compound LNBF module. The antenna dish includes a reflector with N-th order projected aperture and a single compound LNBF module constituting multiple LNBF units. The reflector is formed by projected aperture cutting and surface distortion of the aperture in accordance with the method of analysis and synthesis. In addition to reflecting signals from satellites, it also generates focused waves sharing similar radiation patterns and horizontal gain with incoming waves on the focal plane to be received by the compound LNBF modules.

14 Claims, 3 Drawing Sheets

MULTI-BEAM-REFLECTOR DISH ANTENNA AND METHOD FOR PRODUCTION THEREOF

BACKGROUND OF THE INVENTION

1. Field of the Invention

The present invention relates to a dish antenna, and in particular to a multi-beam-reflector dish antenna, which provides maximum gain from a fixed size according to a method of numerical analysis and synthesis.

2. Description of the Related Art

Satellite communication is gaining importance in this world of real-time digital distribution of audio and video data around the globe. It is known that for the purpose of increasing the data capacity of a satellite system, for example a direct broadcast system (DBS). And the reflector dish antenna system is a popular antenna system applied to satellite communication.

Traditionally, the circular parabolic dish antenna commonly used embodies an equation x^2+y^2=4fz, in which f refers to a focal length of the parabolic dish. A low noise block with integrated feed (LNBF) module is installed on a focal point of the parabolic reflector of the dish antenna for reception and down conversion of the satellite signals. The LNBF module on the focal point receives the satellite signals with extremely high carrier-to-noise ratio(C/N) to raise gain and lower spillover loss and improve quality of received signals. On the other hand, the concentrated character of the focal point on the parabolic dish is strong enough to suppresses signals from unnecessary satellites and generate a considerably lower signal paralleled with the parabolic dish. Furthermore, only by planting more dish antennas to receive other satellite signals for the parabolic dish can get the good performances of all of the satellite signals that we want.

Accordingly, another method provides a dish antenna with several independent LNBF modules for receiving multiple different satellite signals at the same time. The dish antenna with a single compound LNBF module uses less space and costs less, compared to the previous technique. It is also more convenient and practical for users.

Thus, an even more convenient and practical method, saving even more space and cost, is to receive multiple satellite signals by a single compound LNBF module with multiple LMBF modules to achieve the same effect.

The present invention utilizes a theory of physical optics which is referenced to research as follows.

Research Disclosure Vol. 43, NO. 1, "A Generalized Diffraction Synthesis Technique for High Performance Reflector Antenna", IEEE Trans. On Antennas and Propagation, Dah-Ewih Duan and Yahmat-Samii, January 1995, discloses a steepest decent method (SDM) which is a widely employed procedure for the synthesis of shaped reflectors in contoured beam applications. The SDM is efficient in computational convergence, but highly depends on an initial starting point and could very easily reach a local optimum.

SUMMARY OF THE INVENTION

Accordingly, an object of the present invention is to provide a multi-beam-reflector dish antenna with a compound LNBF module for receiving satellite signals transmitted from multiple satellites at the same time.

Another object of the present invention is to provide a method for analyzing a radiation pattern produced by a dish antenna and to produce a dish antenna based thereupon.

Accordingly, the present invention provides a multi-beam-reflector dish antenna, and method of analyzing and producing the same. The dish antenna includes a reflector and a primary low noise block with integrated feed. The reflector of the dish antenna has an Nth-order curve with a minimal dish surface for receiving signals from different satellites within an angle range at the same time, and produces a plurality of corresponding focused waves. The primary LNBF module includes a plurality of sub LNBF modules located on the focal plane of the reflector to receive the focused waves.

A detailed description is given in the following embodiments with reference to the accompanying drawings.

BRIEF DESCRIPTION OF THE DRAWINGS

The present invention can be more fully understood by reading subsequent detailed description and examples with references made to the accompanying drawings, wherein.

DETAILED DESCRIPTION OF THE INVENTION

The present invention is a multi-beam-reflector dish antenna with a single compound LNBF module for receiving multiple different satellite signals at the same time.

Figure 1:
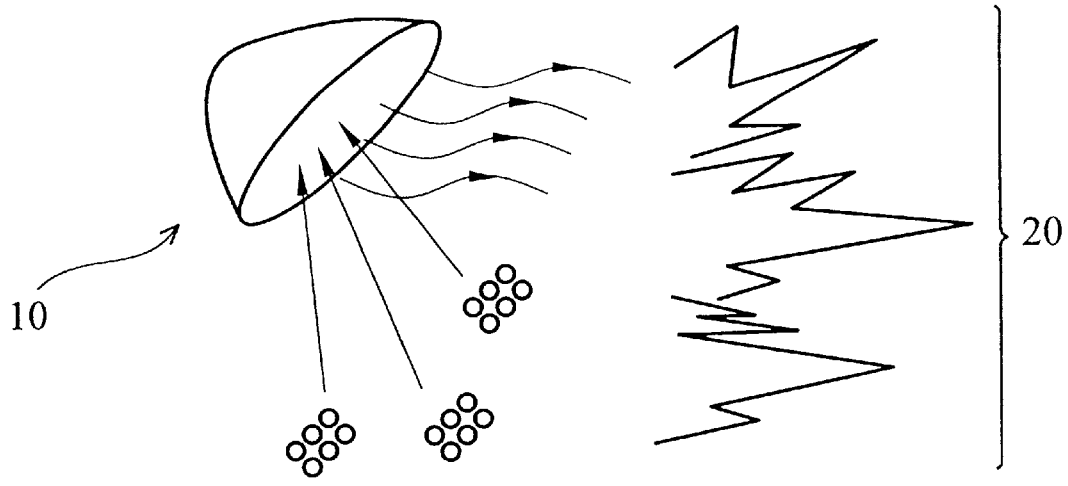
FIG. 1 is a schematic diagram showing a dish antenna system of the present invention.

FIG. 1 is a schematic diagram showing a dish antenna system of the present invention. The multi-beam-reflector dish antenna of the present invention integrates multiple LNBF modules into a single compound LNBF module. The reflector 10 of dish antenna receives satellite signals from different satellites and generates multi-radiation-wave 20. The surface dish of the dish antenna is a reflector with a N-th order projected aperture returned by $F(x)^N+F(y)^N=F(z)$, where N is equal to 2.1 in the present invention.

Figure 2:
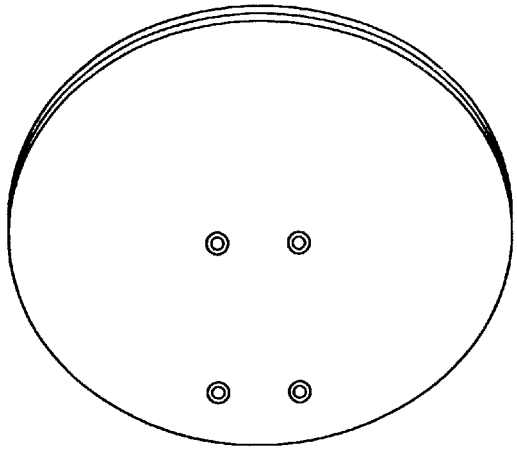
FIG. 2 is a schematic diagram showing the shape of the reflector of the dish antenna of the present invention.

FIG. 2 is a schematic diagram showing the shape of the reflector 10 of dish antenna of the present invention. Furthermore, the reflector 10 of dish antenna is formed through surface distortion, and the shape of the reflector 10 is gained from projection of a super ellipse. The super ellipse is returned by $[x/A]^N+[y/B]^N=1$, where z=f, N is equal to 2.1, A is the horizontal axial length of the N-th order projected aperture and B is the vertical axial length in the present invention.

About the method to get the dish of the present invention, we can discuss form two parts: numerical analysis and synthesis. The importance of analysis is to retrieve radiation pattern produced by the reflector 10 of the dish antenna having given feed horn elements (including radiation waveforms and weights) of the dish antenna. It should be noted that the feed horn element, as radiation waveforms, generally is hypothetical or given on account of the element could be simulated by $\cos^q\theta$, and therefore the variation of the radiation waveforms are not involved in the method of analysis.

Based on theories of physical optics(PO), the cut square measure is performed by a basis expansion(that is to say, performing the basis expansion on the equation above and returning $$z(t, \phi) = \sum_{0}^{n} \sum_{0}^{m} [Cnm\cos n\phi + Dnm\sin n\phi] F_m^n(t))$$

and expansion coefficients $C_{nm}$ and $D_{nm}$ can be obtained by the basis expansion of the N-th order projected aperture and following integrations. Moreover, the coefficients can be used to deduct corresponding radiation patterns, peak angles, gains, sidelobe and others, verified to meet standard conditional values. Main lobes and first sidelobes of the radiation waveforms are critical applications to the dish antenna system. The theory of physical optics performs well with the lobes and is referenced to research as mentioned above.

The object of synthesis is to modify weights and shape of the reflector 10 of the dish antenna to meet a desired standard of waveform generated by the reflector 10 of the dish antenna. Generally, iteration is used to adjust weights of the feed horn elements or the shape of the reflector 10 of the dish antenna in accordance with predetermined conditions of radiation waveforms until the radiation waveforms meet desired conditions.

Briefly, the equation above is given default related data (default value of $C_{nm}$ and $D_{nm}$ of the reflector 10, radiation waveforms of feed horn, coordinates, phase and weights of the relative reflector 10 of dish antenna) of the reflector 10 of dish antenna and desired radiation pattern of the reflector 10 (the lowest and the highest gains of desired angle) in the beginning and thereby starts the synthesis method to get a result fitting the default condition. The radiation pattern is analyzed and measured in accordance with the acquired coefficients to modify the required condition of the radiation pattern. The synthesis method is repeated until the expansion coefficients, $C_{nm}$ and $D_{nm}$, match the radiation pattern. The expansion coefficients are expanded as coordinates of the reflector 10 of the dish antenna for drawing, manufacturing and testing a sample.

Figure 3:
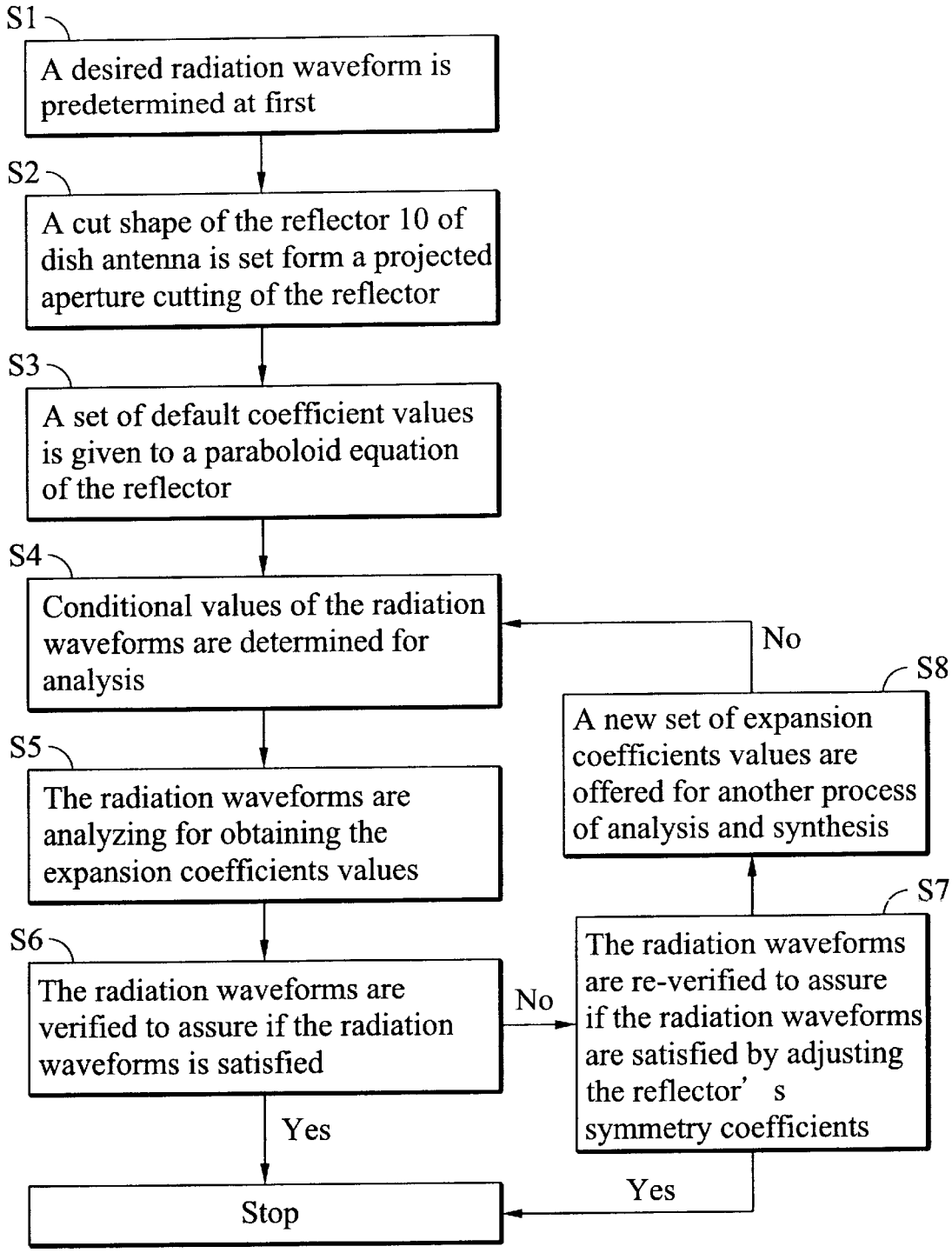
FIG. 3 is a flowchart of detailed steps of the synthesis method of a reflector of dish antenna of the present invention.

FIG. 3 is a flowchart of the detailed steps of synthesis of a reflector 10 for a dish antenna of the present invention. The synthesis of the reflector 10 of dish antenna comprises the following steps.

In step S1, a desired radiation waveform is predetermined. The desired radiation waveform is determined first for analysis and synthesis.

In step S2, a cut shape of the reflector 10 of dish antenna is set from a projected aperture cutting. The shape is gained from projected aperture cutting of the reflector 10 of dish antenna.

In step S3, a set of default coefficient values is given to a paraboloid equation of the reflector 10 of dish antenna. A set of default input expansion coefficient values is acquired in accordance with projected aperture cutting by the paraboloid equation.

In step S4, conditional values of the radiation waveforms are determined. The conditional values of the radiation waveforms include horizontal radius, vertical radius, focal length and length of the central point from z-axis.

In step S5, the radiation waveforms are analyzed to obtain the expansion coefficient values. A set of output expansion coefficient values is acquired in accordance with the radiation waveforms and the condition values above.

In step S6, the radiation waveforms are verified to ensure that the radiation waveforms are satisfied.

In step S7, the radiation waveforms are re-verified to further ensure that the radiation waveforms are satisfied by adjusting the reflector's symmetry coefficients. If the radiation waveforms do not satisfy the default setting, the reflector's symmetry coefficients are adjusted and then the radiation waveforms are re-verified.

In step S8, a new set of expansion coefficient values are offered. If the radiation waveforms still do not satisfy the default setting, the initial expansion coefficients can be replaced with the output expansion coefficients obtained before the symmetry coefficients are adjusted and then the radiation waveforms analysis in step 4 can be repeated until the radiation waveforms produced by the expansion coefficients, $C_{nm}$ and $D_{nm}$, are satisfied.

Synthesis and analysis data of the reflector of dish antenna of the present invention is described in detail below.

Surface of the dish antenna: as shown in FIG. 2.

Figure 4:
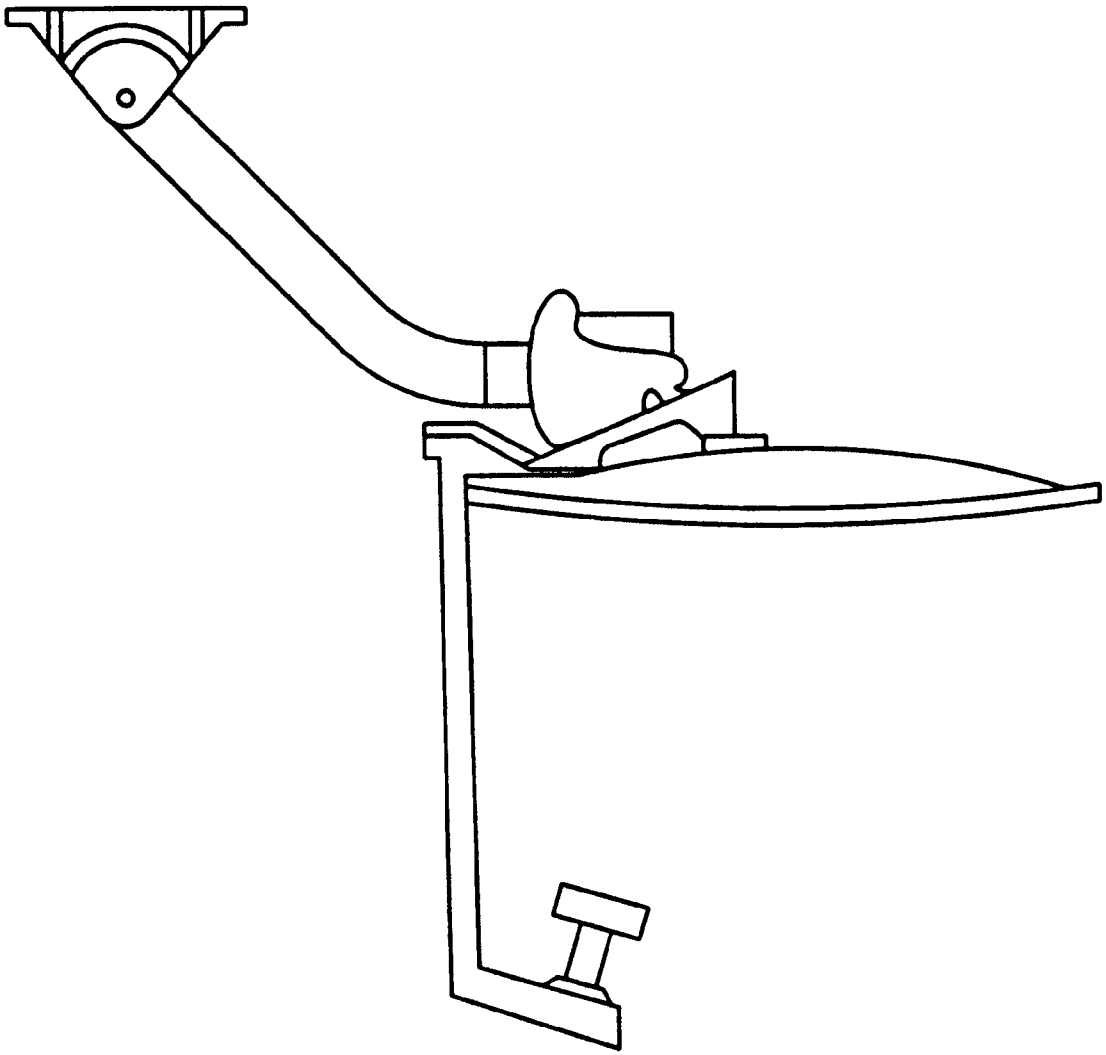
FIG. 4 is a schematic diagram showing the profile of the multi-beam-reflector dish antenna of the present invention.

Profile of the dish antenna: as shown in FIG. 4.

Size of the reflector of dish antenna:

Projection plate: 20.4(inch)*16.94(inch).

Actual size: 20.9(inch)*18.4(inch).

Tolerance of each point of the dish: between +0.02" and −0.02".

Focal length of the reflector: 12.25(inch).

Expansion coefficients of the reflector of dish antenna are listed in Table 1, below:

TABLE 1

| n | m | $C_{nm}$ | $D_{nm}$ |
|---|---|---|---|
| 0 | 0 | −6.886965 | 0.00E+00 |
| 0 | 1 | −0.4044881 | 0.00E+00 |
| 0 | 2 | 4.81E−03 | 0.00E+00 |
| 0 | 3 | −6.92E−04 | 0.00E+00 |
| 1 | 0 | 0.00E+00 | 1.619216 |
| 1 | 1 | 0.00E+00 | −9.52E−03 |
| 1 | 2 | 0.00E+00 | −2.61E−04 |
| 2 | 0 | 0.1238 | 0.00E+00 |
| 2 | 1 | −6.41E−03 | 0.00E+00 |
| 2 | 2 | 1.00E−05 | 0.00E+00 |
| 3 | 0 | 0.00E+00 | 2.35E−02 |
| 3 | 1 | 0.00E+00 | 1.07E−03 |
| 4 | 0 | −1.44E−03 | 0.00E+00 |
| 4 | 1 | 1.12E−03 | 0.00E+00 |
| 5 | 0 | 0.00E+00 | −3.20E−03 |
| 6 | 0 | −2.12E−03 | 0.00E+00 |

Data of analysis and measurement of the dish antenna:

Dish antenna synthesis and analysis data

| Feed Position (x, y, z) Unit: inch | | | Simulation Result | | |
|---|---|---|---|---|---|
| | | | Peak | Directivity | S.L. |
| 0 | −0.071 | −0.056 | 0° | 34.63 dB | −23.63 dB |
| 2.5984 | 0 | 0 | −10.1° | 33.87 dB | −22.75 dB |

Dish antenna synthesis and it data about measurement

| Feed Position (x, y, z) Unit: inch | | | Simulation Result | | |
|---|---|---|---|---|---|
| | | | Peak | Directivity | S.L. |
| 0 | −0.071 | −0.056 | 0° | 34.68 dB | −27.50 dB |
| 2.5984 | 0 | 0 | −10.14° | 33.87 dB | −26.00 dB |

Accordingly, compared with conventional dish antenna technique, the multi-beam-reflector dish antenna has the following advantages.

The reflector of the dish antenna uses the method of numerical analysis and synthesis to deploy surface distortion on a single reflector according to requirements of a multi-beam-reflector dish antenna, and analyzes the synthesized reflector to provide the best possible results according to the generated effect of the dish antenna.

The multi-beam-reflector dish antenna is produced by synthesizing and deforming the single reflector to perform better at wide angles than the conventional techniques (higher gains and better first sidelobe).

The smaller reflector of dish antenna of the present invention is produced by numerical analysis and synthesis, at a lower cost and with better effect.

It is important to utilize surface distortion or phase array feed horn of a single reflector of dish antenna to generate multiple beams, newly applied to the antenna. Not only can the single reflector of dish antenna send signals with bi-directional communication to multiple satellites to save costs while efficiently simultaneously tracking the satellites with each other. Furthermore, it also can be used at point-to-point microwave delivery.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multi-beam-reflector dish antenna system comprising:

a reflector for simultaneously receiving signals from a plurality of satellites; and at least a first low noise block with integrated feed (LNBF) module for receiving focused waves, in which the reflector is formed according to the following steps of:

providing the reflector having N-th order curve surface where the value of factor N equals to 2.1 returned by $F(x)^n+F(y)^n=F(z)$;

executing expansion according to the equation to achieve expansion of $$z(t,\phi)=\sum_{0}^{n}\sum_{0}^{m}[Cnm\cos n\phi+Dnm\sin n\phi]F_m^n(t),$$

in which expansion coefficients of $C_{nm}$ $D_{nm}$ are variables;

analyzing the radiation waveforms of the reflector according to the expansion coefficients of $C_{nm}$ and $D_{nm}$;

synthesizing the radiation waveforms of the reflector to generate a corresponding radiation pattern; and acquiring the multi-beam-reflector dish antenna according to the expansion coefficients, $C_{nm}$ and $D_{nm}$, and the radiation pattern, wherein the values of the expansion coefficients Cnm and Dnm are substantially:

| n | m | Cnm | Dnm |
|---|---|---|---|
| 0 | 0 | −6.886965 | 0.00E+00 |
| 0 | 1 | −0.4044881 | 0.00E+00 |

-continued

| n | m | Cnm | Dnm |
|---|---|---|---|
| 0 | 2 | 4.81E−03 | 0.00E+00 |
| 0 | 3 | −6.92E−04 | 0.00E+00 |
| 1 | 0 | 0.00E+00 | 1.619216 |
| 1 | 1 | 0.00E+00 | −9.52E−03 |
| 1 | 2 | 0.00E+00 | −2.61E−04 |
| 2 | 0 | 0.1238 | 0.00E+00 |
| 2 | 1 | −6.41E−03 | 0.00E+00 |
| 2 | 2 | 1.00E−05 | 0.00E+00 |
| 3 | 0 | 0.00E+00 | 2.35E−02 |
| 3 | 1 | 0.00E+00 | 1.07E−03 |
| 4 | 0 | −1.44E−03 | 0.00E+00 |
| 4 | 1 | 1.12E−03 | 0.00E+00 |
| 5 | 0 | 0.00E+00 | −3.20E−03 |
| 6 | 0 | −2.12E−03 | 0.00E+00. |

2. The multi-beam-reflector dish antenna system as claimed in claim 1, wherein the size of the reflector of dish antenna is substantially 18.4 inches long and 20.9 inches wide.

3. The multi-beam-reflector dish antenna system as claimed in claim 1, wherein a focal length of reflector of dish antenna is 12.25 inches and the tolerance of each point of the dish surface is between 0.02 inches and −0.02 inches.

4. The multi-beam-reflector dish antenna system as claimed in claim 1, wherein the first LNBF module includes a plurality of second LNBF modules.

5. The multi-beam-reflector dish antenna system as claimed in claim 4, further comprising a feed horn positioned at a focal point of the second LNBF module.

6. The multi-beam-reflector dish antenna system as claimed in claim 5, wherein each elevation of the feed horn of the second LNBF modules is 38.45 degrees.

7. The multi-beam-reflector dish antenna system as claimed in claim 5, wherein the horizontal space of the center of each second LNBF module is 66 millimeter.

8. A method for producing a multi-beam-reflector dish antenna system, comprising the steps of:

providing the antenna system with a reflector having N-th order curve where the value of factor N equals to 2.1 returned by $F(x)^n+F(y)^n=F(z)$;

executing expansion according to the equation to achieve the expansion of $$z(t,\phi)=\sum_{0}^{n}\sum_{0}^{m}[Cnm\cos n\phi+Dnm\sin n\phi]F_m^n(t),$$

in which the expansion coefficients of $C_{nm}$ and $D_{nm}$ are variables;

analyzing the radiation waveforms of the reflector according to the expansion coefficients of $C_{nm}$ and $D_{nm}$, the radiation waveforms received by a first LNBF module;

synthesizing the radiation waveforms of the reflector to generate a corresponding radiation pattern; and drawing and acquiring the multi-beam-reflector dish antenna according to the expansion coefficients, $C_{nm}$ and $D_{nm}$, and the radiation pattern;

wherein the values of the expansion coefficients Cnm and Dnm are substantially:

| n | m | Cnm | Dnm |
|---|---|---|---|
| 0 | 0 | −6.886965 | 0.00E+00 |
| 0 | 1 | −0.4044881 | 0.00E+00 |
| 0 | 2 | 4.81E−03 | 0.00E+00 |
| 0 | 3 | −6.92E−04 | 0.00E+00 |
| 1 | 0 | 0.00E+00 | 1.619216 |
| 1 | 1 | 0.00E+00 | −9.52E−03 |
| 1 | 2 | 0.00E+00 | −2.61E−04 |
| 2 | 0 | 0.1238 | 0.00E+00 |
| 2 | 1 | −6.41E−03 | 0.00E+00 |
| 2 | 2 | 1.00E−05 | 0.00E+00 |
| 3 | 0 | 0.00E+00 | 2.35E−02 |
| 3 | 1 | 0.00E+00 | 1.07E−03 |
| 4 | 0 | −1.44E−03 | 0.00E+00 |
| 4 | 1 | 1.12E−03 | 0.00E+00 |
| 5 | 0 | 0.00E+00 | −3.20E−03 |
| 6 | 0 | −2.12E−03 | 0.00E+00. |

9. The method as claimed in claim 8, wherein the size of the reflector of dish antenna is substantially 18.4 inches long and 20.9 inches wide.

10. The method as claimed in claim 8, wherein a focal length of reflector of dish antenna is 12.25 inches and the tolerance of each point of the dish surface is between 0.02 inches and −0.02 inches.

11. The method as claimed in claim 8, wherein the first LNBF module includes a plurality of second LNBF modules.

12. The method as claimed in claim 11, further comprising a feed horn positioned at a focal point of the second LNBF module.

13. The method as claimed in claim 12, wherein each elevation of the feed horn of the second LNBF modules is 38.45 degrees.

14. The method as claimed in claim 12, wherein the horizontal space of the center of each second LNBF module is 66 millimeter.

* * * * *